US007674565B2

(12) United States Patent
Qi et al.

(10) Patent No.: US 7,674,565 B2
(45) Date of Patent: Mar. 9, 2010

(54) PROTECTIVE OVERCOAT

(75) Inventors: Yu Qi, Oakville (CA); Nan-Xing Hu, Oakville (CA)

(73) Assignee: Xerox Corporation, Norwalk, CT (US)

( * ) Notice: Subject to any disclaimer, the term of this patent is extended or adjusted under 35 U.S.C. 154(b) by 702 days.

(21) Appl. No.: 11/459,827

(22) Filed: Jul. 25, 2006

(65) Prior Publication Data

US 2008/0026308 A1 Jan. 31, 2008

(51) Int. Cl.
*G03G 15/02* (2006.01)

(52) U.S. Cl. ..... 430/58.4; 430/58.6; 430/58.65; 430/58.7; 430/59.4

(58) Field of Classification Search ..... 430/58.4, 430/58.6, 58.65, 58.7, 59.4
See application file for complete search history.

(56) References Cited

U.S. PATENT DOCUMENTS

| | | | | |
|---|---|---|---|---|
| 4,265,990 | A | | 5/1981 | Stolka et al. |
| 4,286,033 | A | | 8/1981 | Neyhart et al. |
| 4,291,110 | A | | 9/1981 | Lee |
| 4,298,697 | A | | 11/1981 | Baczek et al. |
| 4,338,387 | A | | 7/1982 | Hewitt |
| 4,338,390 | A | | 7/1982 | Lu |
| 4,457,994 | A | | 7/1984 | Pai et al. |
| 4,560,635 | A | | 12/1985 | Hoffend et al. |
| 4,871,634 | A | | 10/1989 | Limburg et al. |
| 5,368,967 | A | | 11/1994 | Schank et al. |
| 5,418,107 | A | | 5/1995 | Nealey et al. |
| 5,702,854 | A | | 12/1997 | Schank et al. |
| 5,709,974 | A | | 1/1998 | Yuh et al. |
| 5,821,019 | A | * | 10/1998 | Nguyen ..... 430/59.4 |
| 5,976,744 | A | | 11/1999 | Fuller et al. |
| 6,110,628 | A | * | 8/2000 | Sekiya et al. ..... 430/66 |
| 6,139,999 | A | * | 10/2000 | Fuller et al. ..... 430/58.65 |
| 2001/0044060 | A1 | * | 11/2001 | Shida et al. ..... 430/58.2 |

FOREIGN PATENT DOCUMENTS

| | | | |
|---|---|---|---|
| JP | 2000075516 | * | 3/2000 |

OTHER PUBLICATIONS

Abstract of JP 2000075516, Mar. 2000.*
Machine English langauage translation of JP 2000075516, Mar. 2000.*
U.S. Appl. No. 11/260,249, filed Oct. 28, 2005 in the name of Qi et al.
U.S. Appl. No. 11/214,917, filed Aug. 31, 2005 in the name of Qi et al.

* cited by examiner

*Primary Examiner*—Hoa V Le
(74) *Attorney, Agent, or Firm*—Oliff & Berridge, PLC

(57) ABSTRACT

A photoconductive having an overcoat layer that includes a cured or substantially crosslinked product of at least a melamine-formaldehyde resin and a charge transport compound, and an optional phenol compound.

20 Claims, No Drawings

PROTECTIVE OVERCOAT

BACKGROUND

Described herein is a photoconductive member, and more specifically a layered member that comprises an overcoat layer that includes a cured or substantially crosslinked product of at least a melamine-formaldehyde resin, optionally a phenol compound, and a charge transport compound.

The photoconductive members described herein may be used in, for example, electrophotographic imaging devices and xerographic imaging devices, printing processes, color imaging processes, copying/printing/scanning/fax combination systems and the like. The photoconductive member may be, for example, a photoreceptor, and may have any suitable form, for example plate or drum form.

Photosensitive members such as electrophotographic or photoconductive members, including photoreceptors or photoconductors, typically include a photoconductive layer formed on, for example, an electrically conductive substrate or formed on layers between the substrate and photoconductive layer. The photoconductive layer is an insulator in the dark, so that electric charges are retained on its surface. Upon exposure to light, the charge is dissipated, and an image can be formed thereon, developed using a developer material, transferred to a copy substrate, and fused thereto to form a copy or print.

Advanced imaging systems are based on the use of small diameter photoreceptor drums. The use of small diameter drums places a premium on photoreceptor life. A factor that can limit photoreceptor life is wear. Small diameter drum photoreceptors are particularly susceptible to wear because about 3 to 10 revolutions of the drum may be required to image a single letter size page. Multiple revolutions of a small diameter drum photoreceptor to reproduce a single letter size page can thus require about 1 million cycles or more from the photoreceptor drum to obtain 100,000 prints, one desirable print job goal for commercial systems.

For low volume copiers and printers, bias charging rolls (BCR) are desirable because little or no ozone is produced during image cycling. However, the microcorona generated by the BCR during charging damages the photoreceptor, resulting in rapid wear of the imaging surface, for example, the exposed surface of the charge transport layer. More specifically, wear rates can be as high as about 10 microns per 100,000 imaging cycles.

REFERENCES

Various overcoats employing alcohol soluble polyamides have been proposed. Disclosed in U.S. Pat. No. 5,368,967 is an electrophotographic imaging member comprising a substrate, a charge generating layer, a charge transport layer, and an overcoat layer comprising a small molecule hole transporting arylamine having at least two hydroxy functional groups, a hydroxy or multihydroxy triphenyl methane, and a polyamide film forming binder capable of forming hydrogen bonds with the hydroxy functional groups such as the hydroxy arylamine and hydroxy or multihydroxy triphenyl methane.

A crosslinked polyamide overcoat is known, comprising a crosslinked polyamide containing N,N'-diphenyl-N,N'-bis(3-hydroxyphenyl)-(1,1'-biphenyl)-4,4'-diamine, and referred to as LUCKAMIDE®. In order to achieve crosslinking, a polyamide polymer having N-methoxymethyl groups (LUCKAMIDE®) was employed along with a catalyst such as oxalic acid. This overcoat is described in U.S. Pat. No. 5,702,854, the entire disclosure thereof being incorporated herein by reference.

Disclosed in U.S. Pat. No. 5,976,744 is an electrophotographic imaging member including a supporting substrate coated with at least one photoconductive layer, and an overcoating layer. The overcoating layer includes hydroxy functionalized aromatic diamine and a hydroxy functionalized triarylamine dissolved or molecularly dispersed in a crosslinked acrylated polyamide matrix. The hydroxy functionalized triarylamine is a compound different from the polyhydroxy functionalized aromatic diamine.

Disclosed in U.S. Pat. No. 5,709,974 is an electrophotographic imaging member including a charge generating layer, a charge transport layer and an overcoating layer. The overcoating layer includes a hole transporting hydroxy arylamine compound having at least two hydroxy functional groups, and a polyamide film forming binder capable of forming hydrogen bonds with the hydroxy functional groups of the hydroxy arylamine compound.

Disclosed in U.S. Pat. No. 4,871,634 is an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

Disclosed in U.S. Pat. No. 4,457,994 is a layered photosensitive member comprising a generator layer and a transport layer containing a diamine type molecule dispersed in a polymeric binder, and an overcoat containing triphenyl methane molecules dispersed in a polymeric binder.

Disclosed in U.S. Pat. No. 5,418,107 is a process for fabricating an electrophotographic imaging member.

While prior disclosures are acceptable for their intended purposes and disclose photoconductive members having a charge generating layer and a charge transport layer, it is still desired to provide photoconductive members having an improved overcoat layer. Such improved overcoat layers meet required electrical properties, speedy printing demand, long shelf life and fine coating quality.

SUMMARY

In embodiments, disclosed is a photoconductive member comprising a layer having a substantially crosslinked product of a melamine-formaldehyde resin and a charge transport compound. The layer may optionally comprise a phenol compound within the crosslinked structure.

Also disclosed is an image forming apparatus comprising at least one charging unit, at least one exposing unit, at least one developing unit, a transfer unit, a cleaning unit, and a photoconductive member comprising a layer having a substantially crosslinked product of a melamine-formaldehyde resin and a charge transport compound, wherein the charge transport compound is represented by A-(L-OR)$_n$, wherein A represents a charge transport component, L represents a linkage group, O represents oxygen, R represents a hydrocarbyl group, and n represents a number of repeating segments or groups.

In further embodiments, disclosed is an overcoat coating composition comprising a melamine-formaldehyde resin and a charge transport compound. The overcoat coating composition may optionally comprise a phenol compound within the crosslinked structure.

DETAILED DESCRIPTION OF EMBODIMENTS

The present disclosure relates generally to photoconductive members such as photoconductors, photoreceptors and the like, for example which may be used in electrophotographic or xerographic imaging processes. The photoconductive members herein include a layer, such as an overcoat layer, that may achieve adhesion to other layers of the photoconductive members, such as, for example, the charge transport layer, and exhibits excellent coating quality. Thus, the resulting imaging member achieves excellent image quality and mechanical robustness. The protective overcoat layer may increase the extrinsic life of a photoconductive member and may maintain good printing quality and/or deletion resistance when used in an image forming apparatus.

The overcoat layer comprises the cured or substantially crosslinked product of at least a melamine-formaldehyde resin and a charge transport compound. The melamine-formaldehyde resin may further include a phenol compound to generate a melamine-phenol-formaldehyde resin. The overcoat layer may further comprise a polymer binder.

"Cured" herein refers to, for example, a state in which the melamine and formaldehyde and optionally the phenol compounds in the overcoat coating solution have reacted with each other and/or the charge transport compound to form a crosslinked or substantially crosslinked product. "Substantially crosslinked" in embodiments refers to, for example, a state in which about 60% to 100% of the reactive components of the overcoat coating composition, for example about 70% to 100% or about 80% to 100%, are crosslinked.

The curing or crosslinking of the reactive components occurs, in embodiments, following application of the overcoat coating composition to any previously formed structure of the imaging member. The overcoat coating composition thus comprises at least the melamine and formaldehyde, and optionally the phenol compounds, and the charge transport compound.

The term "phenol compound" may include phenolic resins as disclosed herein.

The charge transport compound of the overcoat layer composition can be represented by the formula of A-(L-OR)$_n$, wherein A represents a charge transport component, L represents a linkage group, O represents oxygen, R represents a hydrocarbyl, and n represents the number of repeating segments or groups. For example, the linkage group is an alkylene group having from 1 to about 8 carbon atoms, such as from 1 to about 5 carbon atoms or from 1 to about 6 carbon atoms, and "n" is an integer of 1 to about 8, such as from 1 to about 6 or from 1 to about 5.

"Hydrocarbyl" can refer to univalent groups formed by removing a hydrogen atom from a hydrocarbon. Examples of hydrocarbyls include alkyls, aryls, phenyls, and the like. A suitable hydrocarbyl for use herein may have from 1 to about 25 carbon atoms, such as from 1 to about 15 carbon atoms or from 1 to about 8 carbon atoms. In embodiments, the hydrocarbyl is an alkyl that may be linear or branched, having from 1 to 25 carbon atoms, such as from 1 to about 15 carbon atoms or from 1 to about 8 carbon atoms. If the hydrocarbyl is an alkyl, then (L-OR) may be referred to as an alkoxyalkyl.

In particular, the hydrocarbyl group is attached, via the oxygen atom thereof, to the charge transport component by a linkage group. The linkage group may be an alkylene linkage group, such as methylene, ethylene, propylene and the like.

In embodiments, the charge transport component A is selected from a group consisting of tertiary arylamines, pyrazolines, hydrazones, oxadiazoles, and stilbenes. In embodiments, an example of a tertiary arylamine is a bis(alkoxyalkyl)triarylamine.

In further embodiments, A is represented by the following general formula:

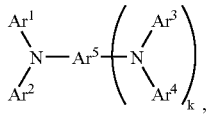

wherein $Ar^1$, $Ar^2$, $Ar^3$ and $Ar^4$ are each independently a substituted or unsubstituted aryl group having from about 1 to about 25 carbon atoms, such as from 1 to about 15 carbon atoms or from 1 to about 8 carbon atoms, $Ar^5$ is a substituted or unsubstituted aryl or arylene group having from about 1 to about 25 carbon atoms, such as from 1 to about 15 carbon atoms or from 1 to about 8 carbon atoms, and k is 0 or 1. At least one of $Ar^1$, $Ar^2$, $Ar^3$ and $Ar^4$ is connected to the linkage group, L.

In yet further embodiments, A is selected from the following groups:

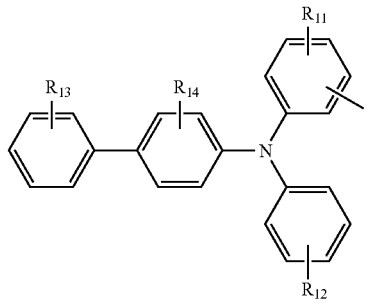

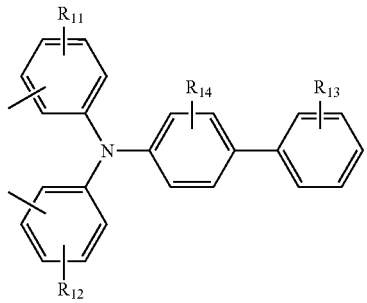

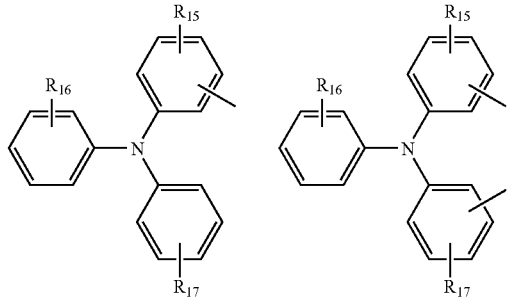

-continued

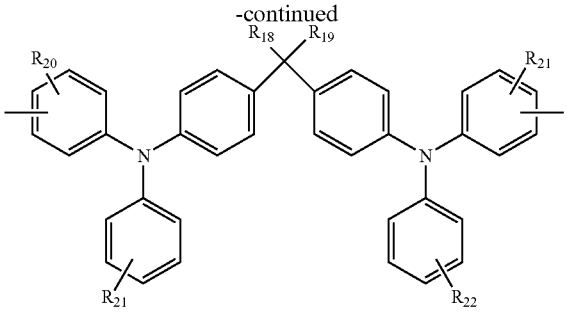

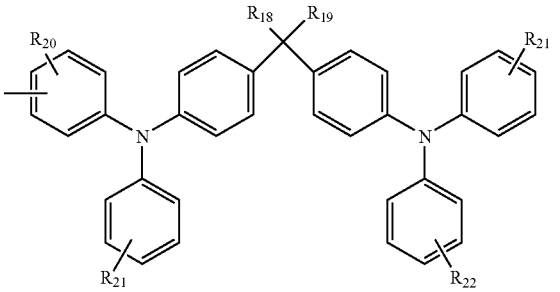

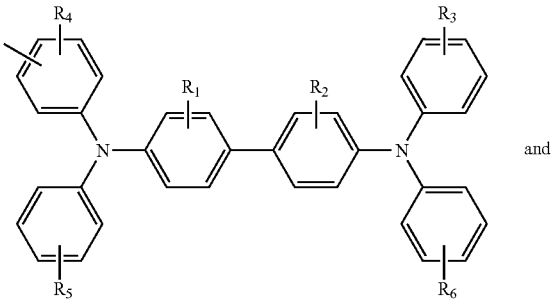

and

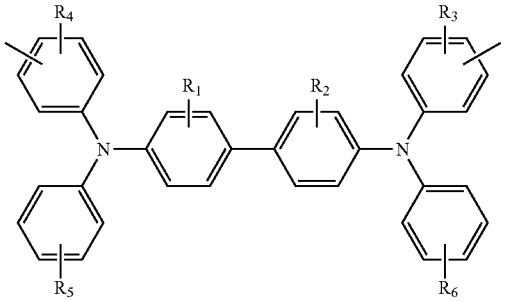

wherein $R_1$ to $R_{23}$ are each a hydrogen atom, an alkyl having for example from 1 to about 20 carbon atoms, such as from 1 to about 15 carbon atoms or from 1 to about 10 carbon atoms, an alkoxyl group having from 1 to about 10 carbon atoms, such as from 1 to about 8 or from 1 to about 5 carbon atoms, or a halogen atom, such as fluorine, chlorine, bromine, iodine and astatine. In embodiments, the alkyl may be linear, branched or cyclic and includes for example, methyl, ethyl, propyl, isopropyl and the like.

The charge transport compound represented by the formula of A-(L-OR)$_n$ may be made by a variety of processes. In embodiments, A-(L-OH)$_n$ is mixed with R—OH in the presence of a catalyst. A condensation reaction occurs between the A-(L-OH)$_n$ and R—OH in the presence of the catalyst to generate A-(L-OR)$_n$ and water. As explained above, A represents a charge transport component, L represents a linkage group, OH represents a hydroxyl, R represents a hydrocarbyl, and n represents the number of repeating segments or groups. Once the condensation reaction is completed, the catalyst is removed from the solvent.

In embodiments, a charge transport compound represented by the formula A-($CH_2$—OR)$_n$ is generated. In such embodiments, A-($CH_2$—OH)$_n$ reacts with R—OH in the presence of a catalyst, and A represents a charge transport component, OH represents a hydroxyl, R represents an alkyl having from 1 to 25 carbon atoms, such as from 1 to about 15 carbon atoms or from 1 to about 8 carbon atoms, and n represents the number of repeating segments or groups.

The catalyst may be an inorganic acid such as hydrochloric acid, sulfuric acid, nitric acid, and the like, and derivatives thereof; an organic acid such as acetic acid, trifluoroacetic acid, oxalic acid, formic acid, glycolic acid, glyoxylic acid, toluenesulfonic acid and the like; or a polymeric acid such as poly(acrylic acid), poly(vinyl chloride-co-vinyl acetate-co-maleic acid), poly(styrenesulfonic acid), and the like. Mixtures of any suitable acids may also be employed.

In embodiments, the catalyst may be a solid state catalyst such as acidic silica, acidic alumina, and a poly(styrenesulfonic acid). Other examples of solid state catalysts include AMBERLITE 15, AMBERLITE 200C, AMBERLYST 15, or AMBERLYST 15E (all are products of Rohm & Haas Co.), DOWEX MWC-1-H, DOWEX 88, or DOWEX HCR-W2 (all are products of Dow Chemical Co.), LEWATIT SPC-108, LEWATIT SPC-118 (both are products of Bayer A. G.), DIAION RCP-150H (a product of Mitsubishi Kasei Corp.), SUMKAION K-470, DUOLITE C26-C, DUOLITE C-433, or DUOLITE 464 (all are products of Sumitomo Chemical Co., Ltd.), NAFION-H (a product of Du Pont), and/or PUROLITE (a product of AMP Ionex Corp.

In the preparation of the charge transport compound, the A-(L-OH)$_n$ material may be present in amounts from about 5 weight percent to about 30 weight percent, such as from about 8 weight percent to about 28 weight percent or from about 10 weight percent to about 25 weight percent, of the reaction mixture. The R—OH may be present in amounts from about 50 weight percent to about 95 weight percent, such as from about 60 weight percent to about 95 weight percent or from about 65 to about 95 weight percent, of the reaction mixture. The catalyst may be present in amounts from about 0.5 weight percent to about 10 weight percent, such as from about 1 weight percent to about 8 weight percent or from about 1 weight percent to about 6 weight percent, of the reaction mixture.

In embodiments, suitable charge transport compounds for use herein include bis(alkoxyalkyl)triarylamine, such as bis(butoxymethylene)triphenylamine or bis(methoxymethylene)triphenylamine.

The overcoat coating composition may contain from about 3 weight percent to about 80 weight percent of the charge transport compound, such as from about 3 weight percent to about 40 weight percent or from about 5 weight percent to about 40 weight percent, or such as from 3 weight percent to about 30 weight percent and from 3 weight percent to about 20 weight percent, of the charge transport compound.

The overcoat coating composition further includes a resin comprising melamine and formaldehyde, that is, a melamine-formaldehyde resin. Such a resin may assist in improving adhesion of the overcoat coating composition to the photoconductive imaging member.

The disclosed melamine-formaldehyde resin may be formed as described herein. However, one of ordinary skill in the art would readily recognize that other suitable reactions may be used to form the melamine-formaldehyde resin. The melamine and formaldehyde react to form methylolmelamines such as depicted in Formula I below:

(Formula I)

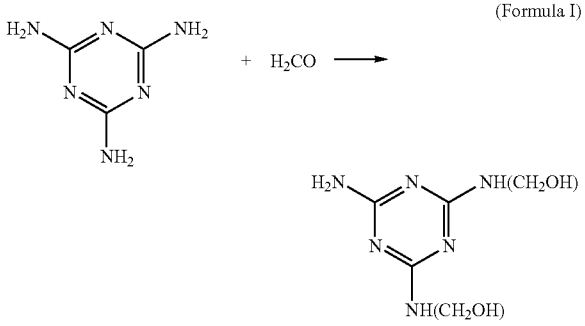

In embodiments, the methylolmelamines, which may be di-, tri-, tetra-, penta- or hexamethylolmelamines, may undergo further resinification reaction via esterification or self-condensation to form melamine-formaldehyde resin and further crosslinked products, as depicted below in Formula II:

(Formula II)

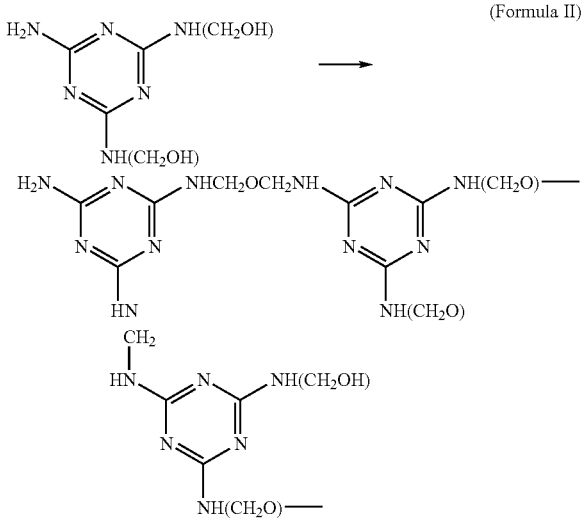

In embodiments, the melamine-formaldehyde resin may be present in the overcoat coating composition in amount from about 1 weight percent to about 80 weight percent, such as from about 3 weight percent to about 70 weight percent or from about 5 weight percent to about 60 weight percent.

In embodiments, the melamine-formaldehyde resin of the overcoat coating composition may also include an optional phenol compound. Phenol compound refers to, for example, any aromatic organic compound in which is present at least one benzene ring with one or more hydroxyl groups attached thereto. A phenol compound may thus also refer to a phenolic resin, such as a resole-type phenolic resin or a novolac-type phenolic resin.

In embodiments, the phenol compound used herein may be any variety of phenol compounds, for example including a phenol itself and its derivatives, resol, xylenol, resorcinol, naphthol and the like. In embodiments, the phenol compound may be 4-hydroxybenzyl alcohol.

In embodiments, the phenol compound may also function as a reactant to achieve phenolic resin products. Phenolic resin herein refers to, for example a condensation product of phenol compound(s) with an additional compound such as an aldehyde (for example formaldehyde or acetaldehyde) or furfural. A resole-type phenolic resin may be formed through a reaction between a phenol and aldehyde, in the presence of a base catalyst. A novolac-type resin may be formed through a reaction between a phenol and an aldehyde, in the presence of an acid catalyst. Of course, suitable phenolic resins may also be commercially obtained.

In embodiments, the phenolic resin may be a resole-type phenolic resin. The weight average molecular weight of the resin may range from, for example, about 300 to about 50,000, such as about 500 to 35,000 or about 1,000 to about 35,000. The phenolic resins that may be employed herein include, for example, PL4852 (Gun'ei Kagaku Kogyo K.K.), formaldehyde polymers with phenol, p-tert-butylphenol and cresol, such as VARCUM® 29159 and 29101 (OxyChem Company) and DURITE® 97 (Borden Chemical), formaldehyde polymers with ammonia, cresol and phenol, such as VARCUM® 29112 (OxyChem Company), formaldehyde polymers with 4,4'-(1-methylethylidene) bisphenol, such as VARCUM® 29108 and 29116 (OxyChem Company), formaldehyde polymers with cresol and phenol, such as VARCUM® 29457 (OxyChem Company), DURITE® SD-423A, SD-422A (Borden Chemical), or formaldehyde polymers with phenol and p-tert-butylphenol, such as DURITE® ESD 556C (Borden Chemical).

In embodiments, the phenolic resin may be a novolac-resin. The weight average molecular weight of this resin may range from about 300 to about 50,000, such as about 500 to 35,000 or about 1,000 to about 35,000 as determined by known methods, such as gel permeation chromatography. Examples of these phenolic resins are for example, 471×75 (cured with HY283 amide hardener), ARALDITE PT810, ARALDITE MY720, and ARALDITE EPN 1138/1138 A-84 (multifunctional epoxy and epoxy novolac resins) from Ciba-Geigy; ECN 1235, 1273 and 1299 (epoxy cresol novolac resins) from Ciba-Geigy; TORLON AI-10 (poly(amideimide) resin) from Amoco; THIXON 300/301 from Whittaker Corp.; TACTIX (tris(hydroxyphenyl) methane-based epoxy resins, oxazolidenone modified tris(hydroxyphenyl) methane-based epoxy resins, and multifunctional epoxy-based novolac resins) from Dow Chemical; and EYMYD resin L-20N (polyimide resin) from Ethyl Corporation, and the like.

When the phenol compound is present to form a melamine-phenol-formaldehyde resin, the following compound is derived:

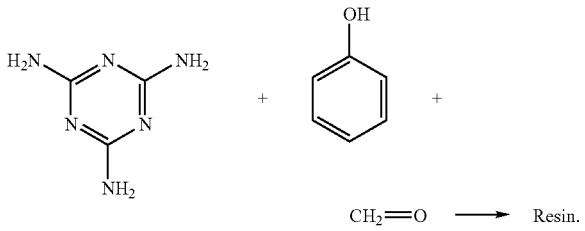

Although the structure shown above is an unsubstituted phenol, substituted phenols and phenol derivatives may be equally suitable, as discussed above.

In embodiments, when a phenol compound is present, the overcoat coating composition may comprise from about 1 weight percent to about 30 weight percent of the phenol compound therein, such as from about 2 weight percent to about 15 weight percent or from about 3 weight percent to about 12 weight percent, of the phenol compound.

The components of the overcoat coating composition may be dispersed in a coating solvent. Examples of components that can be selected for use as coating solvents in the overcoat coating composition include ketones, alcohols, aromatic hydrocarbons, halogenated aliphatic hydrocarbons, ethers, amides, esters, and the like. Specific examples of solvents include cyclohexanone, acetone, methyl ethyl ketone, methanol, ethanol, 1-butanol, amyl alcohol, 1-methoxy-2-propanol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

Solvents suitable for use herein should not interfere with other components of the overcoat coating composition or the photoconductive member structure, and evaporate from the overcoat coating composition during curing. In embodiments, the solvent is present in the overcoat coating composition in an amount from about 50 weight percent to about 90 weight percent, such as from about 50 weight percent to about 85 weight percent or from about 50 weight percent to about 80 weight percent, of the overcoat coating composition.

The overcoat coating composition may further include optional components such as a polymer binder and the like. A polymer binder may be employed to achieve improved coating and coating uniformity.

The polymer binder may include one or a combination of thermoplastic and thermosetting resins such as polyamide, polyurethane, polyvinyl acetate, polyvinyl butyral, polysiloxane, polyacrylate, polyvinyl acetal, phenylene oxide resin, terephthalic acid resin, phenoxy resin, epoxy resin, acrylonitrile copolymer, cellulosic film former, poly(amideimide), and the like. These polymers may be block, random or alternating copolymers. The polymer binder such as polyvinylbutyral (PVB) may provide a desired rheology for the coating, and may improve the coating quality of the overcoat film. In embodiments, the polymer binder is polyvinyl butyral.

The polymer binder may include a hydroxyl group-containing polymer, such as an aliphatic polyester, an aromatic polyester, a polyacrylate, an aliphatic polyether, an aromatic polyether, a polycarbonate, a polysiloxane, a polyurethane, a (polystyrene-co-polyacrylate), poly(2-hydroxyethyl methacrylate), an alkyd resin, or mixtures thereof, wherein the polymer contains at least a hydroxyl group.

In embodiments, if present, the polymer binder is present in the overcoat coating composition in an amount from about 1 weight percent to about 50 weight percent, such as from about 1 weight percent to about 25 weight percent or from about 1 weight percent to about 20 weight percent or such as from about 1 weight percent to about 15 weight percent, of the overcoat coating composition.

In embodiments, the overcoat coating composition is first prepared by mixing the melamine-formaldehyde resin, and optionally the phenol compound, with the charge transport compound in an alcohol solution and an acid catalyst. In embodiments, optional components may be mixed into the overcoat coating composition.

The overcoat coating composition may be applied by any suitable application technique, such as spraying dip coating, roll coating, wire wound rod coating, and the like. In embodiments, the overcoat coating composition may be coated onto any layer of the photoconductive imaging member, such as the charge transport layer, the charge generating layer, a combination charge transport/charge generating layer, or the like.

After the overcoat coating composition is coated onto the photoreceptor device, the coating composition can be cured at a temperature from about 50° C. to about 250° C., such as from about 80° C. to about 200° C. or from about 100° C. to about 175° C. The deposited overcoat layer may be cured by any suitable technique, such as oven driving, infrared radiation drying, and the like.

The curing may take from about 1 minute to about 90 minutes, such as from about 3 minutes to about 75 minutes or from about 5 minutes to about 60 minutes. The curing reaction substantially forms a crosslinked structure, which may be confirmed when the overcoat layer does not dissolve in part or in its entirety when contacted with organic solvents. Thus, organic solvents may be used to confirm the formation of a crosslinked or substantially cross inked product. If a substantially crosslinked product is formed, the organic solvent will not usually dissolve any component of the overcoat layer. Such suitable organic solvents may include alkylene halide, like methylene chloride; alcohol methanol, ethanol, phenol, and the like; ketone, like acetone; and the like. Any suitable organic solvent, and mixtures thereof, may be employed to confirm the formation of a substantially crosslinked overcoat layer if desired.

Without limiting the disclosure herein, demonstrated below is one example of a possible reaction of the charge transport compound and melamine-formaldehyde resin to form the crosslinked structure found in the overcoat layer disclosed herein. One of ordinary skill in the art would recognize that the charge transport compound and melamine-formaldehyde resin may react and crosslink by any suitable reaction.

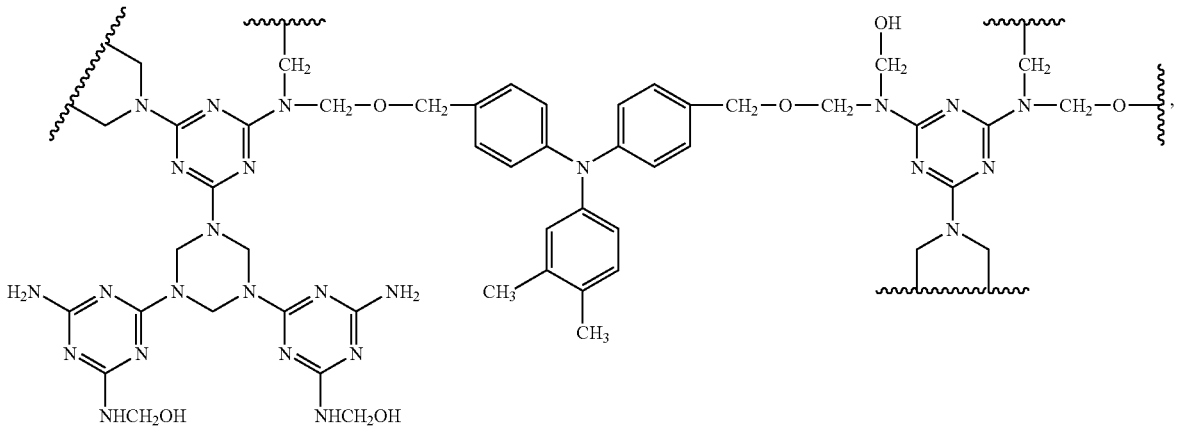
OH
CH2
CH2
CH2
N
N
N

The overcoat layer described herein may be continuous and may have a thickness of less than about 75 micrometers, for example from about 0.1 micrometers to about 60 micrometers, such as from about 0.1 micrometers to about 50 micrometers or from about 1 to about 25 micrometers.

The overcoat layer disclosed herein in embodiments can achieve excellent adhesion to the charge transport layer or other adjacent layers of the photoconductive imaging member without substantially negatively affecting the electrical performance of the imaging member to an unacceptable degree.

The photoconductive members are, in embodiments, multilayered photoreceptors that comprise, for example, a substrate, an optional conductive layer, an optional undercoat layer, an optional adhesive layer, a charge generating layer, a charge transport layer, and the above-described overcoat layer.

Illustrative examples of substrate layers selected for the photoconductive imaging members, and which substrates may be known substrates and which can be opaque or substantially transparent, comprise a layer of insulating material including inorganic or organic polymeric materials, such as MYLAR®, a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as, a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as polycarbonate materials commercially available as MAKROLON®.

The thickness of the substrate layer depends on a number of factors, including the characteristics desired and economical considerations, thus this layer may be a thickness of about 50 microns to about 7,000 microns, such as from about 50 microns to about 3,000 microns or from about 75 microns to about 3000 microns.

If a conductive layer is used, it is positioned over the substrate. The term "over" as used herein in connection with many different types of layers, as well as the term "under." should be understood as not being limited to instances where the specified layers are contiguous. Rather, the term refers to relative placement of the layers and encompasses the inclusion of unspecified intermediate layers between the specified layers.

Suitable materials for the conductive layer include aluminum, zirconium, niobium, tantalum, vanadium, hafnium, titanium, nickel, stainless steel, chromium, tungsten, molybdenum, copper, and the like, and mixtures and alloys thereof.

The thickness of the conductive layer is, in an embodiment, from about 20 angstroms to about 750 angstroms, such as from about 35 angstroms to about 500 angstroms or from about 50 angstroms to about 200 angstroms, for a suitable combination of electrical conductivity, flexibility, and light transmission. However, the conductive layer can, if desired, be opaque.

The conductive layer can be applied by known coating techniques, such as solution coating, vapor deposition, and sputtering. In embodiments, an electrically conductive layer is applied by vacuum deposition. Other suitable methods can also be used.

If an undercoat layer is employed, it may be positioned over the substrate, but under the charge generating layer. The undercoat layer is at times referred to as a hole-blocking layer in the art.

Suitable undercoat layers for use herein include polymers, such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta (aminoethyl) gamma-aminopropyl trimethoxy silane, isopropyl 4-aminobenzene sulfonyl titanate, di(dodecylbenezene sulfonyl) titanate, isopropyl di(4-aminobenzoyl) isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. No. 4,338,387, U.S. Pat. No. 4,286,033 and U.S. Pat. No. 4,291,110.

The undercoat layer may be applied as a coating by any suitable conventional technique such as spraying, die coating, dip coating, draw bar coating, gravure coating, silk screening, air knife coating, reverse roll coating, vacuum deposition, chemical treatment and the like. For convenience in obtaining layers, the undercoat layers may be applied in the form of a dilute solution, with the solvent being removed after deposition of the coating by conventional techniques such as by vacuum, heating and the like. Drying of the deposited coating may be achieved by any suitable technique such as oven drying, infrared radiation drying, air drying and the like.

In fabricating a photoconductive imaging member, a charge generating layer is deposited and a charge transport layer may be deposited onto the substrate surface either in a laminate type configuration where the charge generating layer and charge transport layer are in different layers or in a single layer configuration where the charge generating layer and charge transport layer are in the same layer along with a binder resin. In embodiments, the charge generating layer is applied prior to the charge transport layer.

The charge generating layer is positioned over the undercoat layer. If an undercoat layer is not used, the charge generating layer is positioned over the substrate. In embodiments, the charge generating layer is comprised of amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generating layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is desired for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film-forming binder material may be employed as the matrix in the charge generating (photogenerating) binder layer. Typical polymeric film forming materials include those described, such as, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

A photogenerating composition or pigment may be present in the resinous binder composition in various amounts. Generally, however, from about 5 percent by volume to about 90 percent by volume of the photogenerating pigment is dispersed in about 10 percent by volume to about 95 percent by volume of the resinous binder, and typically from about 20 percent by volume to about 30 percent by volume of the photogenerating pigment is dispersed in about 70 percent by volume to about 80 percent by volume of the resinous binder composition. The photogenerator layers can also fabricated by vacuum sublimation in which case there is no binder.

In embodiments, any suitable technique may be used to mix and thereafter apply the photogenerating layer coating mixture. Typical application techniques include spraying, dip coating, roll coating, wire wound rod coating, vacuum sublimation and the like. For some applications, the charge generating layer may be fabricated in a dot or line pattern. Removing of the solvent of a solvent coated layer may be effected by any suitable technique such as oven drying, infrared radiation drying, air drying and the like. In embodiments, the charge generating layer is from about 0.1 micrometers to about 100 micrometers thick, such as from about 0.1 micrometers to about 75 micrometers or from about 0.1 micrometers to about 50 micrometers.

In embodiments, a charge transport layer may be employed. The charge transport layer may comprise a charge-transporting molecule, such as, a small molecule, dissolved or molecularly dispersed in a film forming electrically inert polymer such as a polycarbonate. The expression charge transporting "small molecule" is defined herein as a monomer that allows the free charge photogenerated in the generator layer to be transported across the transport layer. In embodiments, the term "dissolved" refers to, for example, forming a solution in which the molecules are distributed in the polymer to form a homogeneous phase. In embodiments, the expression "molecularly dispersed" refers to a dispersion in which a charge transporting small molecule dispersed in the polymer, for example on a molecular scale.

Any suitable charge transporting or electrically active small molecule may be employed in the charge transport layer.

Typical charge transporting molecules include, for example, pyrene, carbazole, hydrazone, oxazole, oxadiazole, pyrazoline, arylamine, arylmethane, benzidine, thiazole, stilbene and butadiene compounds; pyrazolines such as 1-phenyl-3-(4'-diethylaminostyryl)-5-(4'-diethyl amino phenyl) pyrazoline; diamines such as N,N'-diphenyl-N,N'-bis(3-methylphenyl)-(1,1-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis(4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In embodiments, to minimize or avoid cycle-up in machines with high throughput, the charge transport layer may be substantially free (such as, from zero to less than about two percent by weight of the charge transport layer) of triphenylmethane. As indicated above, suitable electrically active small molecule charge transporting compounds are dissolved or molecularly dispersed in electrically inactive polymeric film forming materials.

An exemplary small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1-biphenyl)-4,4'-diamine. If desired, the charge transport material in the charge transport layer may comprise a polymeric charge transport material or a combination of a small molecule charge transport material and a polymeric charge transport material.

In embodiments, the charge transport layer may contain an active aromatic diamine molecule, which enables charge transport, dissolved or molecularly dispersed in a film forming binder. An exemplary charge transport layer is disclosed in U.S. Pat. No. 4,265,990, the entire disclosure of which is incorporated herein by reference.

Any suitable electrically inactive resin binder that is ideally substantially insoluble in the solvent such as alcoholic solvent used to apply the optional overcoat layer may be employed in the charge transport layer. Typical inactive resin binders include polycarbonate resin, polyester, polyarylate, polyacrylate, polyether, polysulfone, and the like. Molecular weights can vary, such as from about 20,000 to about 150,000. Exemplary binders include polycarbonates such as poly(4,4'-isopropylidene-diphenylene)carbonate (also referred to as bisphenol-A-polycarbonate); polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate), and the like.

Any suitable charge transporting polymer may also be utilized in the charge transporting layer of this disclosure. The charge transporting polymer should be insoluble in the solvent employed to apply the overcoat layer. These electrically active charge transporting polymeric materials should be capable of supporting the injection of photogenerated holes from the charge generating material and be capable of allowing the transport of these holes therethrough.

Any suitable technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable technique such as oven drying, infrared radiation drying, air drying and the like.

Generally, the thickness of the charge transport layer is from about 10 to about 100 micrometers, but a thickness outside this range can also be used. A charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of a charge transport layer to the charge generating layers may be maintained from about 2:1 to 200:1, and in some instances as great as 400:1. Typically, a charge transport layer is substantially non-absorbing to visible light or radiation in the region of intended use but is electrically "active" in that it allows the injection of photogenerated holes from the photoconductive layer, that is, charge generation layer, and allows these holes to be transported through itself to selectively discharge a surface charge on the surface of the active layer.

Additionally, adhesive layers can be provided, if necessary or desired, between any of the layers in the photoreceptors to ensure adhesion of any adjacent layers. Alternatively, or in addition, adhesive material can be incorporated into one or both of the respective layers to be adhered. Such optional adhesive layers may have a thickness of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include film-forming polymers, such as polyester, DuPont 49,000 (available from E.I. DuPont de Nemours & Co.), VITEL PE-100 (available from Goodyear Tire and Rubber Co.), polyvinyl butyral, polyvinyl pyrrolidone, polyurethane, polymethyl methacrylate, and the like.

Optionally, an anti-curl backing layer may be employed to balance the total forces of the layer or layers on the opposite side of the supporting substrate layer. An example of an anti-curl backing layer is described in U.S. Pat. No. 4,654,284, the entire disclosure of which is incorporated herein by reference. A thickness from about 70 to about 160 micrometers may be a satisfactory range for flexible photoreceptors.

Processes of imaging, especially xerographic imaging, and printing, including digital, are also encompassed herein. More specifically, the photoconductive imaging members can be selected for a number of different known imaging and printing processes including, for example, electrophotographic imaging processes, especially xerographic imaging and printing processes wherein charged latent images are rendered visible with toner compositions of an appropriate charge polarity. Moreover, the imaging members of this disclosure are useful in color xerographic applications, particularly high-speed color copying and printing processes.

Also included in the present disclosure are methods of imaging and printing with the photoconductive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto.

The following Examples are submitted to illustrate embodiments of the present disclosure.

EXAMPLE 1

Preparation of bis(butoxymethyene)-triphenylamine (Charge Transport Compound 1)

Compound (I)

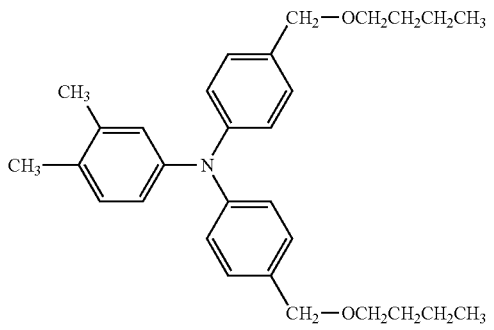

A mixture of di(hydroxymethylene)-triphenylamine (0.25 g), butanol (1 g) and an ion exchange resin AMBERYST® 15 (0.05 g) was shaken at room temperature (about 23° C.) until the reaction was completed as indicated by thin layer chromatography (TLC). The mixture was filtered to remove the AMBERLYST 15 catalyst. Removal of the solvent under reduced pressure yielded charge transport compound (1). The structure was confirmed by $^1$H NMR spectrum.

EXAMPLE 2

Preparation of bis(methoxymethylene)-triphenylamine (Charge Transport Compound 2)

A mixture of 5 g di(hydroxymethylene)-triphenylamine (DHM-TPA), 0.5 g of AMBERLYSST® 15 and 15 g of methanol was shaken at room temperature (about 23° C.) for approximately 12 hours. After isolation of AMBERLYST® 15, the solution was poured into distil led water. The water solution was extracted with ether by introduction of two phases in a separating funnel. The bottom layer was distilled water and the upper layer was ether. The ether layer was dried with $MgSO_4$, excess ether was removed, and the residue was dried with a high vacuum pump, thereby yielding 4.8 g of the bis(methoxymethylene)-triphenylamine. The desired structure of the bis(methoxymethylene)-triphenylamine was confirmed by $^1$H NMR.

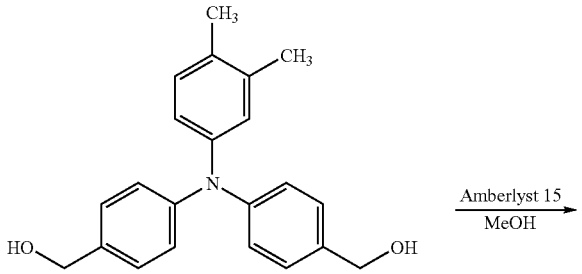

DHM-TPA

-continued

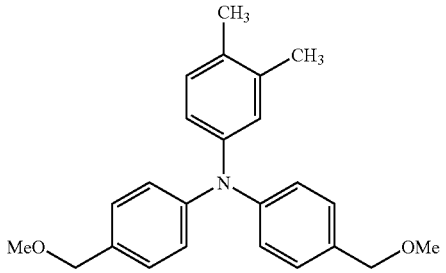

EXAMPLE 3

Preparation of a Melamine-Phenol-Formaldehyde Resin

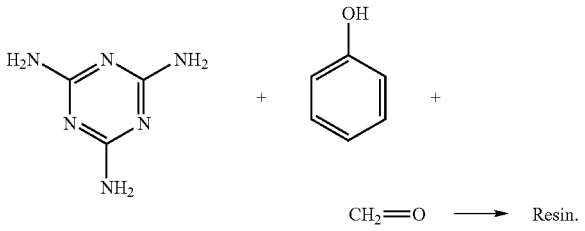

Melamine-phenol-formaldehyde resin may be prepared by any known procedure. For example, 50 g (0.4 mole) of melamine, 37.3 g (0.4 mole) of phenol, and 119 g of 40.3% (1.6 mole) of formaldehyde was added to a resin flask equipped with a mechanical stirrer and condenser. The pH was adjusted to be from about 3 to about 6, and the solution was heated to about 95° C. and kept at that temperature for about half an hour. The resulting solution may be used in formulating coating solutions, be blended with other polymers such as cellulose, or dried and ground up into a powder for use in other formulations.

PHOTORECEPTOR EXAMPLE A

A mixture of 30 g of DHM-TPA, 3 g of AMBERLYST® 15 and 70 g of butanol was shaken at room temperature for about two days, and TLC showed there was only a single product. The solution was collected by filtration and used as the stock solution in Photoreceptor Examples A and B ("charge transport compound (1) stock solution"). 3.67 g of the charge transport compound (1) stock solution was mixed with 0.9 g of melamine-formaldehyde resin and 0.02 g of toluenesulfonic acid (TSA) in 4.43 g of butanol and 1 g of methanol. The mixture was shaken at room temperature (about 23° C.) for approximately two hours to make a homogenous solution. The homogenous solution was applied on the surface of a photoreceptor as a coating solution, and the resulting film was cured at about 130° C. for about 10 minutes. The resulting cured film was resistant to organic solvents such as methanol, butanol and acetone. The photoreceptor exhibited similar electrical characteristics as the control photoreceptor having no overcoat layer.

PHOTORECEPTOR EXAMPLE B 3.67 g of the charge transport compound (I) was mixed with 0.9 g of melamine-formaldehyde resin and 0.02 g of TSA-pyridium in 4.43 butanol and 1 g of methanol. The mixture was shaken at room temperature for about two hours to make a homogenous solution. The coating solution was applied onto the surface of a photoreceptor and the resulting film was cured at about 130° C. for about 10 minutes. The resulting cured film was resistant to organic solvents such as methanol, butanol and acetone. The photoreceptor exhibited similar electrical characteristics as the control photoreceptor having no overcoat layer.

PHOTORECEPTOR EXAMPLE C

A mixture of 30 g of DHM-TPA, 3 g of AMBERLYST® 15 and 70 g of butanol was shaken at room temperature for about two days, and TLC showed there was only a single product. The solution was collected by filtration and used as the stock solution for the overcoat formulation. 3.67 g of bis(butoxymethylene-triphenylamine solution was mixed with 0.6 g of melamine-formaldehyde resin, 0.3 g of 4-hydroxybenzyl alcohol and 0.02 g of TSA in 4.43 butanol and 1 g of methanol. The mixture was shake at room temperature (about 23° C.) for about two hours to make a homogenous solution. The coating solution was applied to the surface of a photoreceptor ad the resulting film was cured at about 130° C. for about 10 minutes. The resulting cured film was resistant to organic solvents such as methanol, butanol and acetone. The photoreceptor exhibited similar electrical characteristics as the control photoreceptor having no overcoat layer It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A photoconductive member comprising:

a layer comprising a substantially crosslinked product of a film-forming composition comprised of at least a melamine-formaldehyde resin and a charge transport compound, wherein the charge transport compound is represented by:

$$A\text{-}(L\text{-}OR)_n$$

wherein A represents a charge transport component, L represents a linkage group, O represents oxygen, R represents an alkyl having 1 to about 8 carbon atoms, and n represents a number of repeating segments or groups.

2. The photoconductive member according to claim 1, wherein the linkage group is an alkylene.

3. The photoconductive member according to claim 2, wherein the hydrocarbyl is selected from the group consisting of a methyl, an ethyl, a propyl, a butyl, and a mixture thereof.

4. The photoconductive member according to claim 2, wherein the alkylene is a methylene.

5. The photoconductive member according to claim 1, wherein A is a tertiary arylamine, pyrazoline, hydrazone, oxadiazole or stilbene.

6. The photoconductive member according to claim 1, wherein the charge transport component is represented by the following general formula

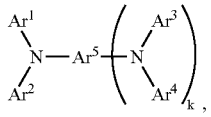

wherein $Ar^1$, $Ar^2$, $Ar^3$ and $Ar^4$ are each independently a substituted or unsubstituted aryl group having from about 1 to about 25 carbon atoms, $Ar^5$ is a substituted or unsubstituted aryl or arylene group having from about 1 to about 25 carbon atoms, and k is 0 or 1, wherein at least one of $Ar^1$, $Ar^2$, $Ar^3$ and $Ar^4$ is connected to the linkage group.

7. The photoconductive member according to claim 1, wherein the charge transport component is selected from the group consisting of:

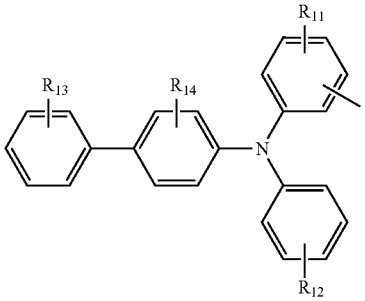

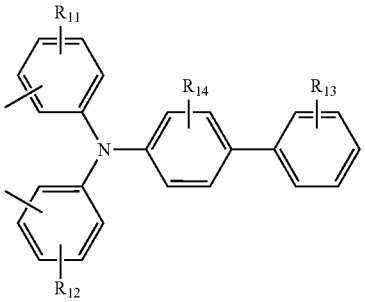

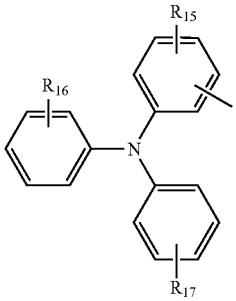

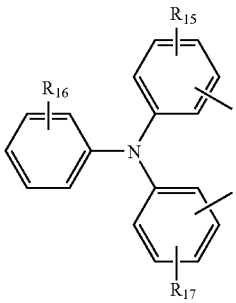

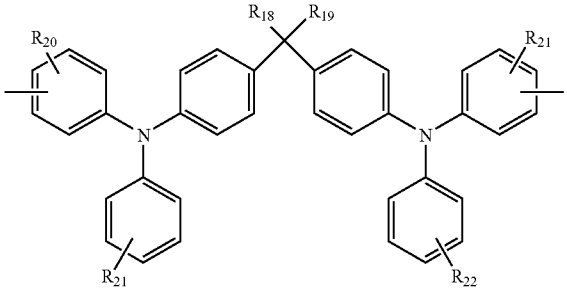

-continued

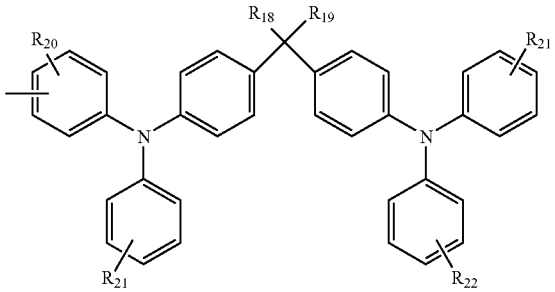

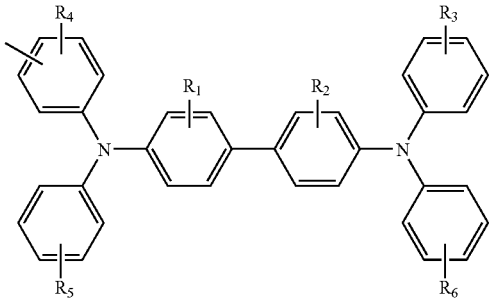

and

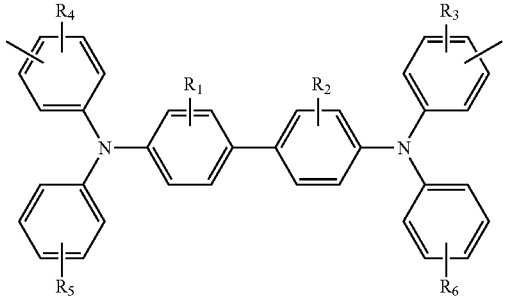

and wherein $R_1$ to $R_{23}$ are each independently selected from the group consisting of a hydrogen atom, an alkyl group, an alkoxy group and halogen atoms.

8. The photoconductive member according to claim 1, wherein the charge transport compound is selected from the group consisting of

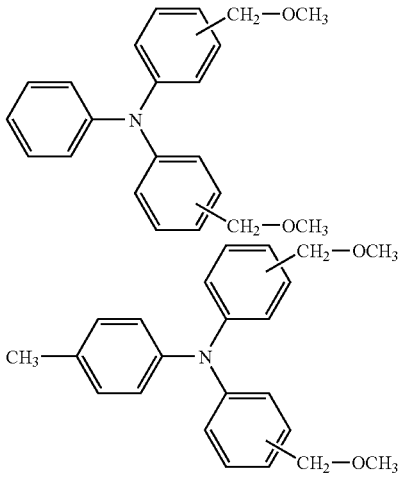

-continued

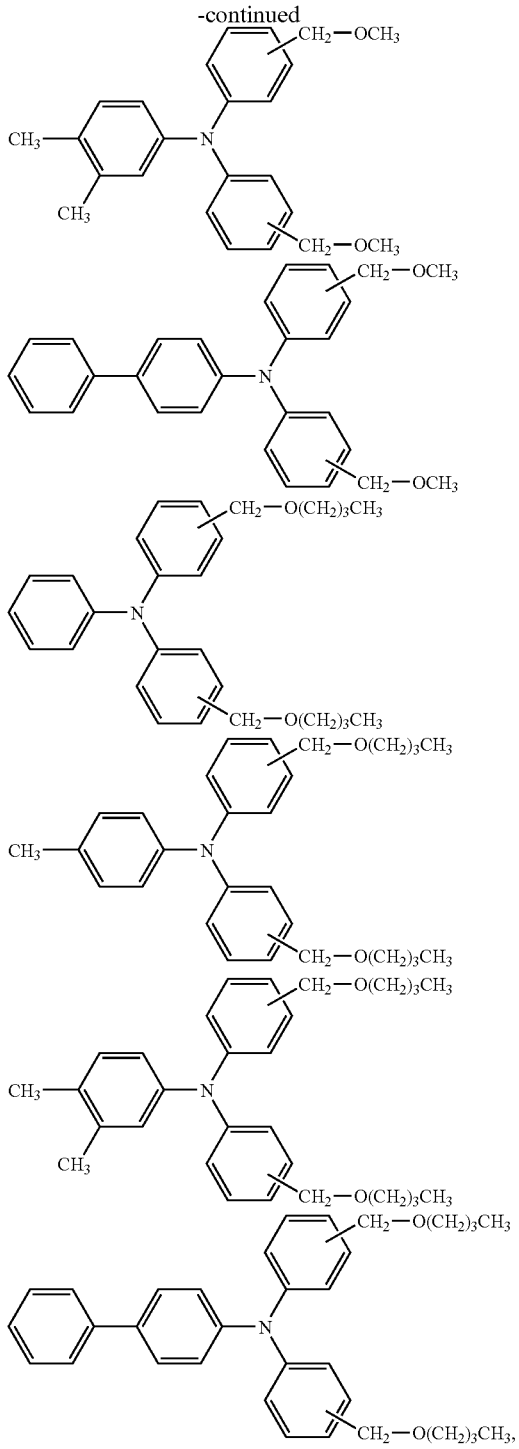

and mixtures thereof.

9. The photoconductive member according to claim 1, wherein the film-forming composition further comprises a phenol compound.

10. The photoconductive member according to claim 9, wherein the phenol compound is selected from the group consisting of a phenol, resol, xylenol, resorcinol, naphthol, and 4-hydroxybenzyl alcohol.

11. The photoconductive member according to claim 9, wherein the phenol compound is a phenolic resin selected from the group consisting of a novalac, resole phenolic resin, and a melamine-phenol-formaldehyde resin.

12. The photoconductive member according to claim 1, wherein the film forming composition comprises from about 3 to about 80 percent by weight of charge transport compound and from about 1 to about 80 percent by weight of melamine-formaldehyde resin.

13. The photoconductive member according to claim 1, wherein the film-forming composition further comprises an acid catalyst.

14. The photoconductive member according to claim 1, wherein the film forming composition further comprises a polymer binder selected from the group consisting of polyamide, polyurethane, polyvinyl acetate, polysiloxane, polyacrylate, polyvinyl acetal, phenylene oxide resin, terephthalic acid resin, phenoxy resin, epoxy resin, acrylonitrile copolymer, cellulosic film former, and poly(amideimde).

15. The photoconductive member according to claim 1, wherein the film forming composition further comprises a hydroxyl group-containing polymer selected from the group consisting of an aliphatic polyester, an aromatic polyester, a polyacrylate, an aliphatic polyether, an aromatic polyether, a polycarbonate, a polysiloxane, a polyurethane, a (polystyrene-co-polyacrylate), poly(2-hydroxyethyl methacrylate), an alkyd resin, and polyvinylbutylral, wherein the polymer contains at least a hydroxyl group.

16. The photoconductive member according to claim 1, wherein the layer has a thickness of from about 0.1 micrometers to about 60 micrometers.

17. The photoconductor member according to claim 1, further comprising:

a conductive substrate, a charge generating layer, a charge transport layer, and wherein the layer is in contact with the charge transport layer.

18. The photoconductive member according to claim 17, wherein the charge generating layer and the charge transport layer are contained in a single layer, and wherein the layer is in contact with the single layer.

19. The photoconductive member according to claim 17, wherein the charge generating layer includes at least a phthalocyanine.

20. An image forming apparatus comprising:

at least one charging unit, at least one exposing unit, at least one developing unit, a transfer unit, a cleaning unit, and a photoconductive member comprising a layer having a substantially crosslinked product of a film-forming composition comprised of a melamine-formaldehyde resin and a charge transport compound, wherein the charge transport compound is represented by:

$$A\text{-}(L\text{-}OR)_n$$

wherein A represents a charge transport component, L represents a linkage group, O represents oxygen, R represents an alkyl having 1 to about 8 carbon atoms, and n represents a number of repeating segments or groups.

* * * * *